United States Patent [19]

Nagai et al.

[11] 4,257,303

[45] Mar. 24, 1981

[54] ELECTRONIC MUSICAL INSTRUMENT OF PARTIALS SYNTHESIS TYPE

[75] Inventors: Yohei Nagai; Shimaji Okamoto, both of Hamamatsu, Japan

[73] Assignee: Nippon Gakki Seizo Kabushiki Kaisha, Hamamatsu, Japan

[21] Appl. No.: 61,742

[22] Filed: Jul. 30, 1979

[30] Foreign Application Priority Data

Jul. 31, 1978 [JP] Japan ..... 53/93458

[51] Int. Cl.[3] ..... G10H 1/10; G10H 7/00

[52] U.S. Cl. ..... 84/1.22; 84/1.24; 84/DIG. 4

[58] Field of Search ..... 84/1.01, 1.03, 1.11, 84/1.12, 1.19, 1.21, 1.22–1.24, DIG. 4

[56] References Cited

U.S. PATENT DOCUMENTS

| | | | |
|---|---|---|---|
| 3,809,786 | 5/1974 | Deutsch | 84/1.01 |
| 3,809,790 | 5/1974 | Deutsch | 84/1.01 |
| 3,888,153 | 6/1975 | Deutsch | 84/1.01 |
| 3,913,442 | 10/1975 | Deutsch | 84/1.23 X |
| 4,077,294 | 3/1978 | Hiyoshi et al. | 84/1.23 |
| 4,103,582 | 8/1978 | Chibana | 84/1.24 |
| 4,112,803 | 9/1978 | Deutsch | 84/1.24 |
| 4,122,744 | 10/1978 | Uetrecht | 84/1.24 X |
| 4,132,140 | 1/1979 | Chibana | 84/1.22 X |
| 4,149,440 | 4/1979 | Deforeit | 84/1.01 |
| 4,150,600 | 4/1979 | Deutsch | 84/1.24 X |
| 4,205,577 | 6/1980 | Deutsch | 84/1.21 |

*Primary Examiner*—Stanley J. Witkowski
*Attorney, Agent, or Firm*—Claude A. S. Hamrick

[57] ABSTRACT

An electronic musical instrument of a partials synthesis type and the partials are processed in a time division multiplex fashion. One cycle of the time division multiplex sequence consists of a plurality of processing time slots, which are divided into two to four groups. Each group of time slots are used for processing partials which form a discrete musical tone. Thus two to four types of musical tones can be formed at the same time, which realizes an ensemble performance.

3 Claims, 4 Drawing Figures

ELECTRONIC MUSICAL INSTRUMENT OF PARTIALS SYNTHESIS TYPE

BACKGROUND OF THE INVENTION

This invention relates to an electronic musical instrument of a partials synthesis type wherein there are provided a predetermined number of partials wave computation time slots which are allotted for calculation of respective tone partial components including a fundamental wave (basic tone) and the harmonics thereof (overtones) which in combination constitute a musical tone and wherein respective components calculated by the time slots are multiplied with corresponding amplitude coefficients and the resulting products are synthesized to form a musical tone.

A typical electronic musical instrument of the partials (harmonics) synthesis type utilizing a digital technique is disclosed in U.S. Pat. No. 3,809,786. In this electronic musical instrument each one of W (number including fundamental) harmonic components are independently calculated in consecutive time slots or time intervals $t_c=t_x/W$, where $t_x$ represents an interval of calculating the amplitude value of a musical tone waveform at a sample point. Thus, each one of W harmonic wave computation time slots is made to correspond to a specific harmonic wave component. For instance, a first harmonic wave component is calculated in a first harmonic wave computation time slot $t_{c1}$, a second harmonic wave component is calculated in a second harmonic wave computation time slot $t_{c2}$ and so on, so that the Wth harmonic wave component is calculated in the Wth harmonic wave computation time slot. Accordingly, in a prior art electronic musical instrument of this type, in response to a depressed key, a musical tone comprising synthesized W harmonic wave components is always formed. In this case, the resulting musical tone is a tone of a single predetermined kind and of the tone pitch corresponding to the depressed key.

Generally, when playing musical instruments, an ensemble of a plurality of musical instruments has been conducted for the purpose of enhancing the effect of the performance.

However, with the prior art electronic instrument described above, a musical tone of only a single kind is generated for one depressed key so that it is impossible to obtain an ensemble performance. Especially, it has been impossible to simultaneously generate a plurality of musical tones having different pitches in response to one depressed key. With the prior art electronic musical instrument, if it is desired to provide an ensemble performance by simultaneously generating a plurality of musical tones having slightly different tone pitches and different tone colors in response to a single depressed key, it is necessary to provide a plurality of parallel-connected harmonic component computation channels or time slots described above. This not only complicates the circuit construction but also increases the cost of manufacturing.

SUMMARY OF THE INVENTION

Accordingly, it is an object of this invention to provide an improved electronic musical instrument capable of providing an ensemble performance with a simple construction.

To accomplish this object, according to this invention, the correspondence among respective time slots and the orders of the partials or harmonics are made to be arbitrarily settable instead of making W partials wave computation time slots to fixedly correspond to the orders of respective partials, and the W partials wave computation time slots are divided into a plurality of groups so as to compute desired partial wave components adapted to form discrete musical tones with the divided groups. Division of W partials wave computation time slots into groups is selectively performed with such suitable set means as an electric switch or the like. Consequently, when W partials wave computation time slots are divided into two groups, it becomes possible to simultaneously form two kinds of musical tones, and when the time slots are divided into four groups, it becomes possible to simultaneously form four kinds of musical tones. Of course, if no group division is made a single musical tone signal could be formed just in the same manner as in the prior art.

More particularly, according to this invention there is provided an electronic musical instrument of a partials synthesis type comprising a circuit for generating frequency information signal corresponding to a tone pitch of a depressed key; a tone combination designator for selectively designating a plurality of tone combinations to be produced, each tone combination comprising at least two tone colors; an order number memory device including a plurality of tone combination memory areas respectively corresponding to the tone combinations, each area including at least two memory sections respectively corresponding to the tone colors, each section being adapted to store the number of orders of partials required to synthesize each of the tone colors; an amplitude coefficient memory device adapted to store amplitude coefficients of respective partials corresponding to respective order numbers; means responsive to the output of the frequency information generating means and to the outputs of the order number memory device for producing a plurality of tone partial waves having predetermined instantaneous wave values; a multiplier means for multiplying the instantaneous wave values with corresponding outputs of the amplitude coefficient memory device; and means for synthesizing multiplication products produced by the multiplier.

DESCRIPTION OF THE PREFERRED EMBODIMENTS

Figure 1:
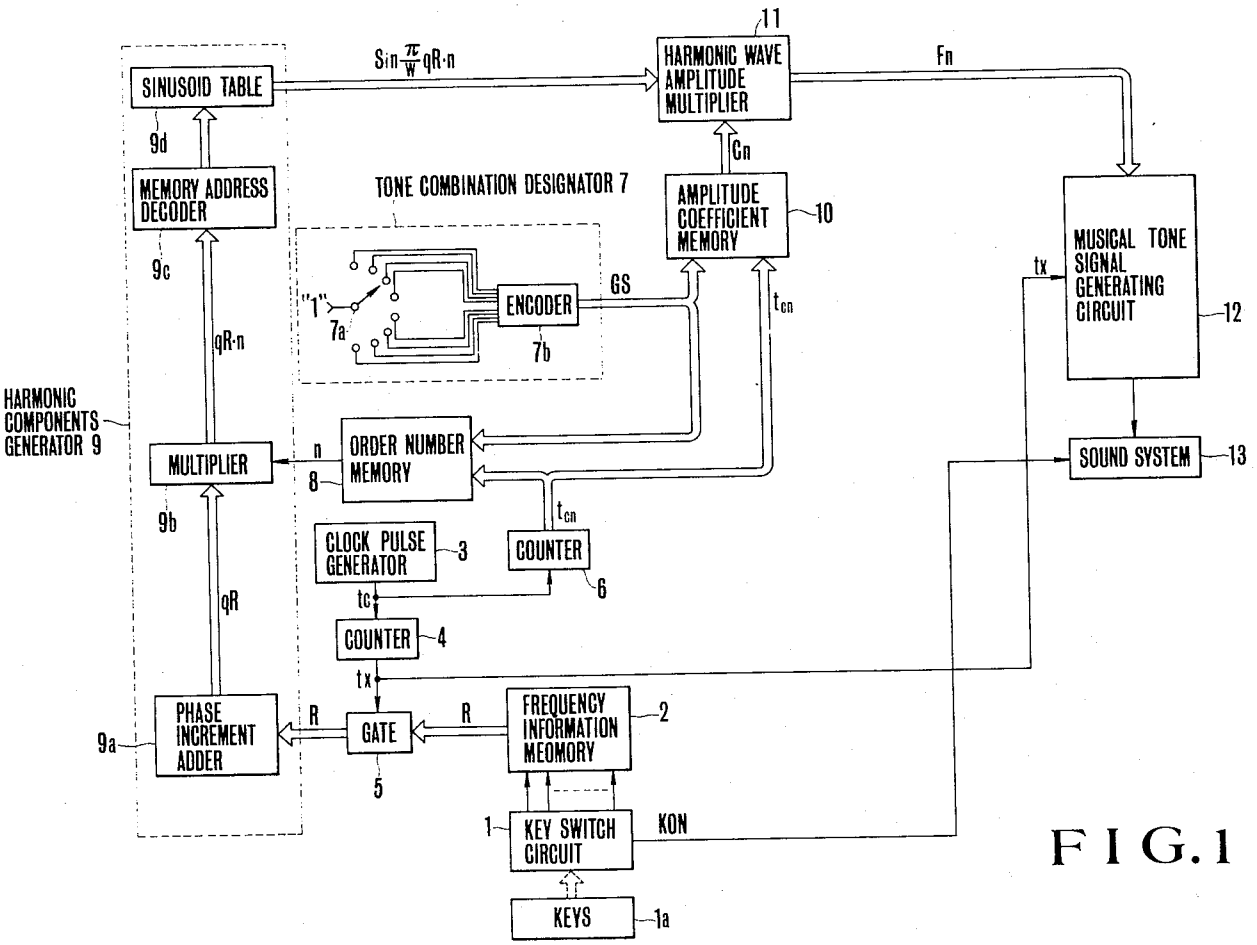
FIG. 1 is a block diagram showing one embodiment of an electronic musical instrument according to this invention.

A preferred embodiment of the electronic musical instrument of this invention shown in FIG. 1 comprises a key switch circuit 1 provided for the keyboard and including a plurality of key switches corresponding to respective keys 1*a* of the keyboard. When a selected key is depressed, a key switch corresponding thereto is operated to produce a signal of a logic value "1" on an output line. The electronic musical instrument further comprises a frequency information memory device 2 adapted to store frequency numbers R corresponding to the tone pitches of respective keys in respective addresses of the memory device. The frequency information memory device 2 is constructed to be addressed by the output of the key switch circuit 1 for reading out a frequency number R corresponding to the pitch of a depressed key. There are also provided a clock pulse generator 3 for producing a clock pulse $t_c$ having a definite period, a counter 4 which divides the frequency of the clock pulse $t_c$ by W (the number of the harmonic wave computation time slots) for producing a computation interval timing signal $t_x$, a gate circuit 5 enabled by each computation interval timing signal $t_x$ for supplying a frequency number R to a harmonic components generator 9 to be described later, and a modulo-W counter 6 which counts the number of clock pulses $t_c$ to produce its count as a harmonic wave computation time slot number $t_{cn}$ ($t_{cl}$–$t_{cw}$) representing a time slot of a specific order among W harmonic wave computation time slots. If desired, the function of the counter 6 may be provided by the counter 4. Further, there is provided a tone combination designator 7 which designates one of 8 types of musical tone combinations $G_1$ through $G_8$ corresponding to 8 types of ensemble performance tones and includes a selector switch 7*a* and an encoder 7*b* which encodes signals representing the musical tone combinations ($G_1$ through $G_8$) corresponding to the performance tones selected and designated by the selector switch 7*a* for producing a performance tone designation signal GS($GS_1$–$GS_8$).

Figure 2:
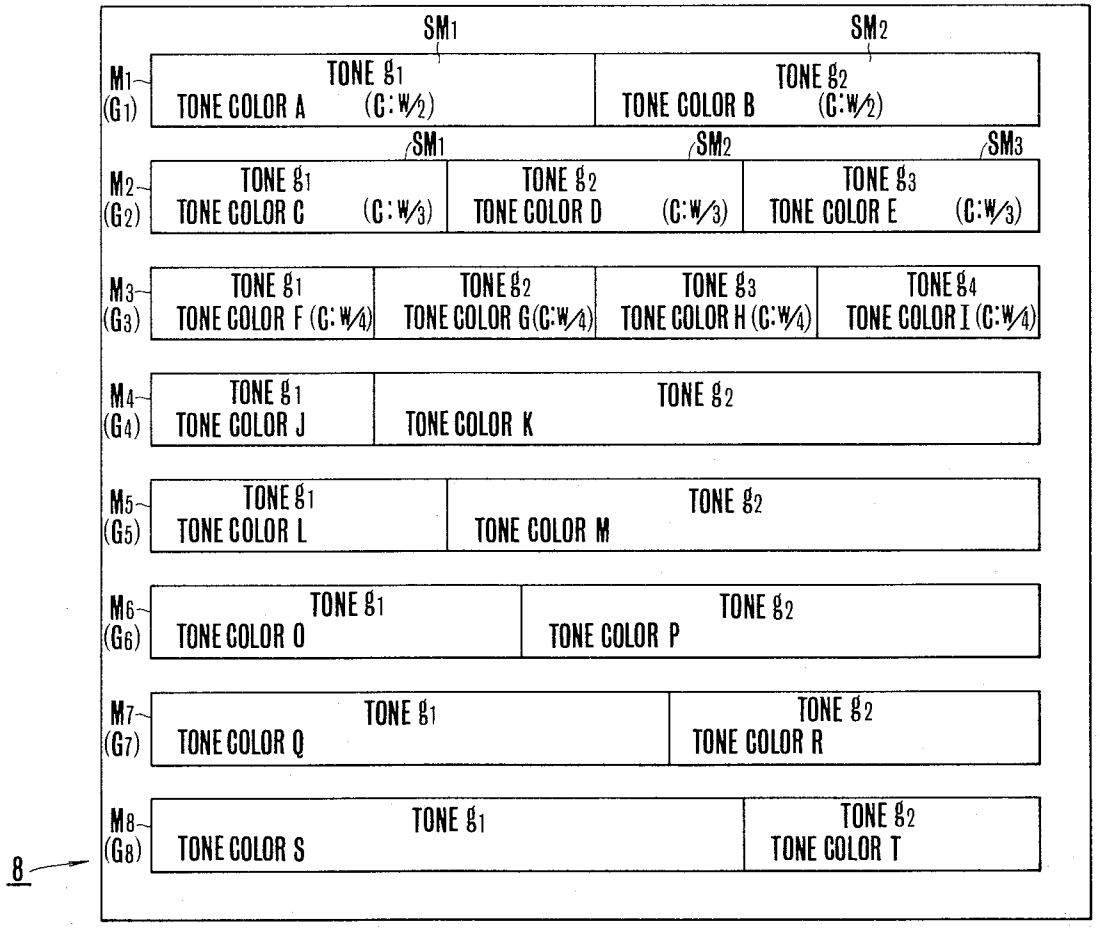
FIG. 2 is a diagrammatic representation of the construction of the order number memory device shown in FIG. 1.

An order number memory device 8 is provided which is adapted to store the order numbers n representing the order numbers of a harmonic waves necessary for synthesizing a plurality of musical tones at each one of the musical tone combinations $G_1$ through $G_8$. As shown in FIG. 2, the order number memory device 8 comprises 8 tone combination memory areas $M_1$ through $M_8$ corresponding to the 8 types of the tone combinations $G_1$ through $G_8$, each memory area including memory section $SM_1$, $SM_2$ . . . corresponding to a plurality of musical tones $g_1$, $g_2$, . . . respectively assigned to the tone combinations $G_1$ through $G_8$. The number of the memory sections correspond to the number of divisions of the W harmonic wave computation time slots. Respectively memory sections store order numbers n representing the order numbers of the harmonic waves necessary to synthesize musical tones $g_1$, $g_2$ . . . assigned. More particularly, assume now that the order numbers of the harmonic waves necessary to synthesize musical tones $g_1$ and $g_2$ assigned to a tone combination $G_1$ corresponding to a designating signal are expressed by, for example, "first (fundamental wave), second, fourth, sixth, 8th, 10th, 12th, 14th" and "first, 5th, 6th, 8th, 15th, 20th, 25th, 32th," the order numbers n representing the aforementioned order numbers would be stored in the memory sections $SM_1$ and $SM_2$ of the tone combination memory area $M_1$. In this case, if the pitches of the musical tones $g_1$ and $g_2$ were made to be just equal, satisfactory ensemble performance would not be obtained, so it is desirable to set the values of the order numbers n such that the musical tones $g_1$ and $g_2$ will have slightly different pitches. More particularly, the value of the order number n regarding the musical tone $g_1$ having a tone color A and to be stored in the memory section $SM_1$ is set to be "1.000 (first), 2.000 (second), 3.998 (fourth) . . . ," whereas the value of the order number n regarding the musical tone $g_2$ having a tone color B and to be stored in the memory section $SM_2$ is set to be "1.005 (first), 5.001 (fifth), 6.000 (sixth) . . . . " When set in this manner, the pitch of the musical tone $g_2$ having the tone color B would become slightly higher than that of the musical tone $g_1$ of the tone color A. The total number of the harmonic wave components ultimately synthesized in the tone combinations $G_1$–$G_8$ is W. Consequently, the number of the order number stored in respective tone combination memory areas $M_1$–$M_8$ is also W. In this regard, the letters C in parenthesis represent the number of the harmonic wave components synthesized in musical tones $g_1$, $g_2$ . . . respectively having tone colors A, B, . . . . The order number memory device 8 is connected to be addressed by a tone combination designating signal GS produced by the tone combination designator 7 and by a harmonic wave computation time slot number signal $t_{cn}$ produced by the counter 6 so that one of the tone combination memory areas $M_1$–$M_8$ is designated by a tone combination designating signal GS ($GS_1$–$GS_8$) whereby respective order numbers n stored in the designated tone combination memory areas are sequentially read out by the harmonic wave computation time slot number signals $t_{cn}$ ($t_{cl}$–$t_{cw}$). For example, where a tone combination memory area $M_1$ corresponding to a tone combination $G_1$ is designated by a tone combination designating signal GS, during an interval of from $t_{cl}$ to $t_{cw/2}$ of the harmonic wave computation time slot numbers, the order numbers n stored in the memory section $SM_1$ are sequentially read out, whereas during an interval of from $t_{c(w/2+1)}$ to $t_{cw}$ of the harmonic wave computation time slot numbers, the order numbers n would be sequentially read out.

The harmonic components generator 9 generates respective harmonic components based on the frequency number R and the order number n and comprises a phase increment adder or accumulator 9*a* which accumulates the number of the frequency numbers R applied thereto via the gate circuit 5 each time a computation interval timing signal $t_x$ is generated for producing an accumulated value qR (q=1, 2 . . . ) and designates amplitude sampling points to be calculated of the generated musical tone waveform, a multiplier 9*b* which multiplies the accumulated value qR with the order number n for producing the product qR·n as a signal representing the phase of the n-th harmonic wave at each sample point, a memory address decoder 9*c* which decodes the product qR·n, and a sinusoid table 9*d* responsive to the output of the memory address decoder 9*c* for reading out sample point amplitude values corresponding to the respective products qR·n among respective sample point amplitude values during one period of a sine waveform stored in respective addresses, the read out sample point amplitude value representing the sine wave amplitude value $\sin \pi/W\, qR{\cdot}n$ of each harmonic wave. There is also provided an amplitude coefficient memory device 10 adapted to stores harmonic wave amplitude coefficients $C_n$ utilized to set amplitude values of respective harmonic components corresponding to respective order numbers n stored in the order number memory device 8. Like the order number memory device 8, this amplitude coefficient memory device 10 is also constructed as shown in FIG. 2 and may be considered to store the harmonic wave amplitude coefficients $C_n$ instead of the order numbers n that are stored in the order number memory device 8. Like the order number memory device 8, the amplitude coefficient memory device 10 is addressed by a tone combination designating signal GS ($GS_1$–$GS_8$) and a harmonic wave computation time slot number signal $t_{cn}$ for sequentially reading out its memory contents. The electronic musical instrument of this invention further comprises a harmonic wave coefficient multiplier 11 which functions to multiply the sine wave amplitude value $\sin \pi/W\, qR{\cdot}n$ of each harmonic wave produced by the harmonic wave component generating circuit 9 with a harmonic wave amplitude coefficient $C_n$ produced by the amplitude coefficient memory device 10 to produce an amplitude value $F_n = C_n \sin \pi/W\, qR{\cdot}n$ for each harmonic wave; a musical tone signal generating circuit 12 which consecutively accumulates the amplitude values of respective harmonic waves each time a computation interval timing signal $t_x$ is generated so as to convert the accumulated value into an analogue signal utilized as a musical tone signal; and a sound system which converts the musical signals supplied from the musical tone signal generating circuit into musical tones. Although not shown in the drawing, the sound system 13 is provided with an envelope signal generator initiated by a key-ON signal KON produced by the key switch circuit 1, whereby such amplitude envelopes as an attack, a sustain, a decay, etc. are imparted to the musical tones in accordance with the envelope shape signals generated by the envelope signal generator.

The electronic musical instrument constructed as above described operates as follows:

After selecting and designating an ensemble performance tone of a musical tone combination $G_1$ comprising two types of the musical tones $g_1$ and $g_2$ respectively having the tone colors A and B, for example, shown in FIG. 2, when a key 1*a* on the keyboard is depressed, a frequency number R corresponding to the tone pitch of the depressed key will be read out from the frequency number memory device 2. The read out frequency number R is applied to the harmonic wave component generator circuit 9 via the gate circuit 5 each time a computation interval timing signal $t_x$ is generated to be sequentially accumulated by the phase increment adder 9*a* of the harmonic wave component generator 9 so as to form accumulated values qR that designate sample points to be calculated of the musical tone waveform amplitude.

On the other hand, the counter 6 sequentially counts the number of the clock pulses $t_c$ for producing its count as a harmonic wave computation time slot number signal $t_{cn}$ ($t_{cl}$–$t_{cw}$) representing the order of the time slot among W harmonic wave computation time slots. The harmonic wave computation time slot number signal $t_{cn}$ thus produced is supplied to the order number memory device 8 and the amplitude coefficient memory device 10 to act as an address signal.

Furthermore, the tone combination designator 7 produces a designating signal $GS_1$ corresponding to an ensemble performance tone (musical tone combination $G_1$) selected by a selector switch 7*a* and the designating signal $GS_1$ is supplied to the order number memory device 8 and to the amplitude coefficient memory device 10 to act as an address signal.

In this manner, as the designating signal $GS_1$ and the harmonic wave computation time slot number signal $t_{cn}$ ($t_{cl}$–$t_{cw}$) are applied to the order number memory device 8 to act as the address signal, order numbers n stored in a tone combination memory area ($M_1$ shown in FIG. 2) corresponding to the designating signal $GS_1$ would be sequentially read out according to the harmonic wave computation time slot number signal $t_{cn}$. Meanwhile, since the harmonic wave computation time slot number signal $t_{cn}$ sequentially varies as $t_{c1}$, $t_{c2}$, $t_{c3}$ . . . , the order numbers n corresponding to the musical tone $g_1$ of the tone color A and to the musical tone $g_2$ of the tone color B which have been stored in the memory sections $SM_1$ and $SM_2$ respectively of the tone combination memory area $M_1$ are sequentially read out.

Thus, the order numbers n having two tone colors A and B (musical tones $g_1$ and $g_2$) assigned to the tone combination memory area $G_1$ read out from the order number memory device 9 are supplied to the multiplier 9*b* of the harmonic wave components generator 9 in which the order numbers are multiplied with the accumulated value produced by the phase increment adder 9*a*. Meanwhile, the accumulated value qR varies at each generation of the computation interval timing signal $t_x$ so that the harmonic wave computation time slot number signal $t_{cn}$ varies as $t_{c1}$, $t_{c2}$, $t_{c3}$ . . . $t_{cw}$ at each generation of the clock pulse $t_c$ with the result that the rate of speed variation in the accumulated value is W times of that of the harmonic wave computation time slot number signal $t_{cn}$. Consequently, while the accumulated value qR is maintained at a constant value, all of the order numbers n (W) corresponding to two musical tone signals $g_1$ and $g_2$ are read out from the order number memory device 8 and the order numbers thus read out are sequentially multiplied with the accumulated value in the multiplier 9*b* so that the product qR n of the accumulated value qR and the order number n is produced by the multiplier 9*b* as a signal that designates the phase of the n-th harmonic wave at each sample point. The product qR·n produced by the multiplier 9*b* is decoded by a memory address decoder 9*c* into an address signal for the sinusoid table 9*d* thus causing it to produce a sine wave amplitude value $\sin \pi/W\, qR{\cdot}n$ of a harmonic wave corresponding to the product qR·n.

Since the amplitude coefficient memory device 10 is addressed by a tone combination designating signal $GS_1$ and a harmonic wave computation time slot number signal $t_{cn}$, as above described, the amplitude coefficient memory device 10 produces a harmonic wave amplitude coefficient $C_n$ stored in an address corresponding to the harmonic wave computation slot number signal $t_{cn}$ of a tone combination corresponding to the tone combination designating signal $GS_1$. Since both the order number memory device 8 and the amplitude coefficient memory device 10 are addressed by the tone combination designating signal $GS_1$ and the harmonic wave computation time slot number signal $t_{cn}$, the order number n and the harmonic wave amplitude coefficient are synchronized with each other. As a consequence, the harmonic wave amplitude coefficient $C_n$ produced by the amplitude coefficient memory device 10 corresponds to the sine wave amplitude values $\sin \pi/W\, qR{\cdot}n$ of respective harmonic wave components which constitute the musical tones $g_1$ and $g_2$ respectively having tone colors A and B and produced by the sinusoid table 9*d* of the harmonic wave component generator 9. Thus, the sine wave amplitude value $\sin \pi/W\, qR{\cdot}n$ of a harmonic wave comprising the musical tones generated by the harmonic component generator 9 is multiplied with the corresponding harmonic wave amplitude coefficient $C_n$ in the harmonic wave amplitude multiplier 11 thereby setting the amplitude values $F_n$ of each harmonic wave. The harmonic wave components of the music tones having colors A and B and having amplitude values set in this manner are converted into a musical signal by the musical tone signal generating circuit 12 to produce a musical tone from the sound system 13. The musical tone generated by the sound system 13 takes the form of an ensemble performance tone designated by the tone combination designator 7, that is, a performance signal produced by synthesizing two musical tones $g_1$ and $g_2$ having different pitches and colors.

It will be clear that when another ensemble performance tones (tone combinations $G_2$–$G_8$) are designated by the tone combination designator 7, performance tones produced by the synthesis of a plurality of musical tones can be produced in the same manner.

Where a plurality of the order numbers n and the harmonic wave amplitude coefficient $C_n$ are stored corresponding to a plurality of tones having different performances in a range of W harmonic wave computation time slots, as shown in FIG. 2, it is possible to simultaneously generate a plurality of types of musical tones having different colors or pitches when a single key is depressed thus giving a feeling as if a plurality of musical instruments are performed simultaneously.

Figure 3:
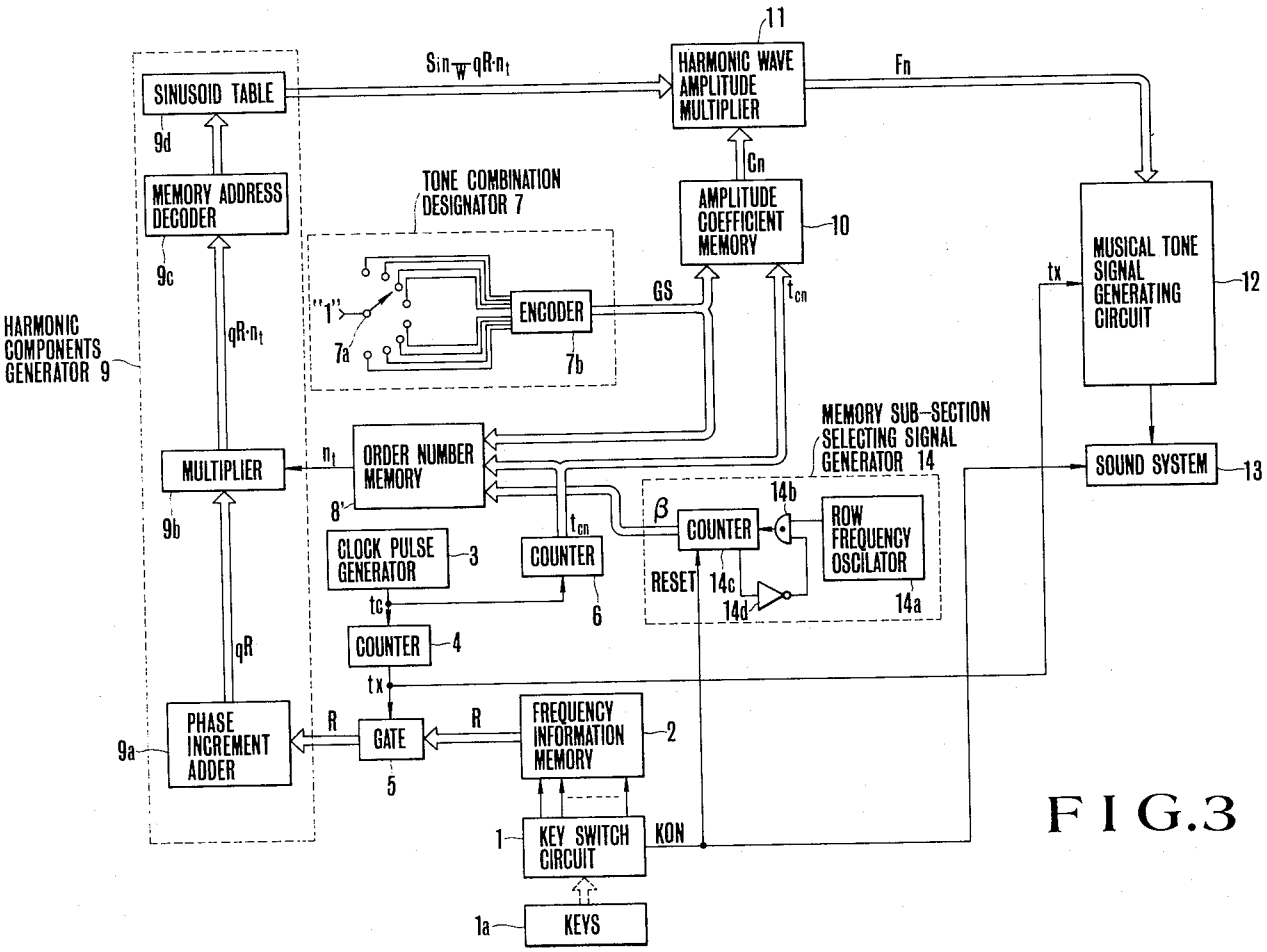
FIG. 3 is a block diagram showing a modified embodiment of an electronic musical instrument embodying the invention.
Figure 4:
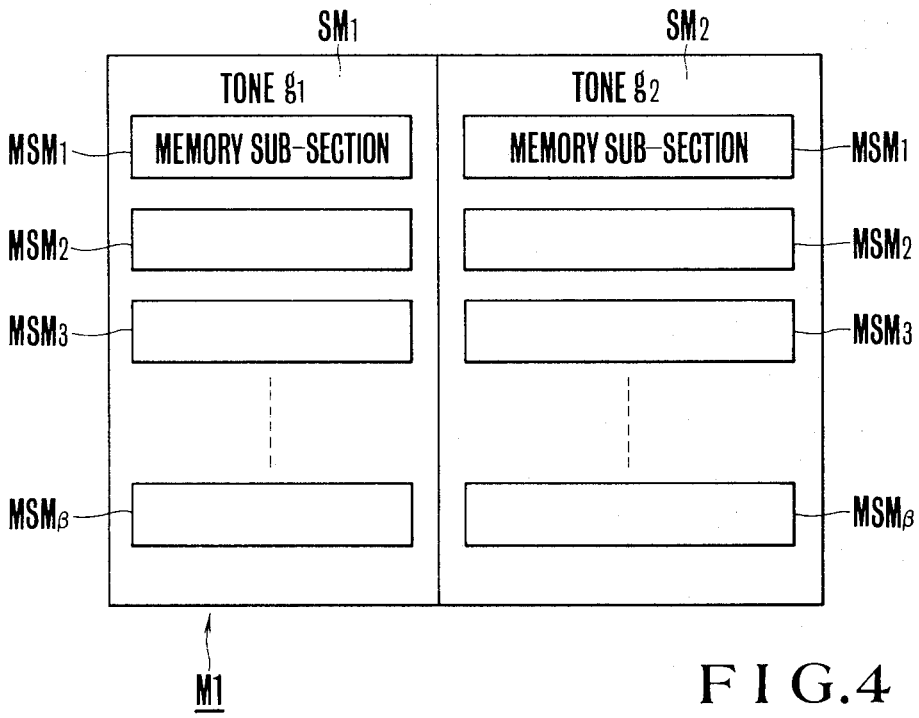
FIG. 4 is a diagrammatic representation showing the memory construction of memory sub-sections contained in the memory sections of the order number memory device shown in FIG. 3.

FIG. 3 shows a modified embodiment of the electronic musical instrument of this invention in which elements corresponding to those shown in FIG. 1 are designated by the same reference characters. The block diagram shown in FIG. 3 is different from that shown in FIG. 1 in that a memory sub-section selecting signal generator 14 is added which produces a varying signal $\beta$ whose value varies gradually at a predetermined speed, the varying signal being used to address the order number memory device 8'. In this modification, respective memory sections $SM_1$, $SM_2$ of the order number memory device 8' are provided with memory sub-sections $MSM_1$–$MSM_\beta$ corresponding to respective values of varying signal $\beta$. FIG. 4 shows how a memory section $M_1$ is subdivided into a plurality of minor memory sections. Respective minor memory sub-sections $MSM_1$–$MSM_\beta$ store sets of order numbers n, the values being slightly different for adjoining minor memory sub-sections. The selecting signal generator 14 comprises a low frequency oscillator **14*a* of the variable frequency type, and a counter 14*c* which is reset by the build up portion of key-ON signal KON (which shows that either one of the keys has been depressed) produced by the key switch circuit 1 and then counts the number of the low frequency pulses generated by the low frequency oscillator 14*a* and applied thereto through an AND gate circuit 14*b* thereby producing its count as the varying signal $\beta$. The counter 14*c* operates such that it produces a maximum value signal when its count reaches a maximum value, the maximum signal being inverted by an inverter 14*d* thus disenabling the AND gate circuit 14*b*. For this reason, the counter 14*c* stops its counting operation when its count reaches the maximum value. Thus, the order number n read out from the order number memory device 8' becomes a time varying order number which varies with time. More particularly, as a tone combination designating signal GS, a harmonic wave computation time slot number signal $t_{cn}$ and a varying signal $\beta$ are supplied to the order number memory device 8' to act as the address signals, order number n stored in the memory sub-sections corresponding to the varying signal of a memory section corresponding to the tone combination designating signal GS are sequentially read out in accordance with the harmonic wave computation time slot number signal $t_{cn}$. Comparison of the rates of speed variation of the harmonic wave computation time slot number signal $t_{cn}$ and of the varying signal $\beta$ shows that the variation speed of the variation signal $\beta$ is much lower than that of the former and that they are asynchronous. Accordingly, while the value of the varying signal $\beta$ is equal to 1, the harmonic wave computation time slot number signal $t_{cn}$ varies several periods, and thereafter the values of the varying signal $\beta$ becomes equal to 2, and so forth. Accordingly, when $\beta=1$, a set of the order numbers n stored in the memory sub-section $MSM_1$ corresponding to $\beta=1$ are sequentially addressed by the harmonic wave computation time slot number signal $t_{cn}$ to be read out repeatedly. When $\beta=2$, the set of the order numbers n stored in the memory sub-section $MSM_2$ are read out similarly. As pointed out above, since the order numbers n stored in respective memory sub-sections $MSM_1$–$MSM_\beta$ differ slightly, the order numbers n would be produced as a time varying order number $n_t$. This time varying order number $n_t$ is multiplied with the accumulated value qR in the multiplier 9*b* of the harmonic wave components generator 9 to produce a product $qR \cdot n_t$ which is used as a signal that designates the phase of the n-th harmonic wave at each sample point. The product $qR \cdot n_t$ is decoded by the memory address decoder 9*c* to cause the sinusoid table 9*d* to produce a sine wave amplitude $\sin \pi/W\ qR \cdot n_t$ corresponding to the product $qR \cdot n_t$. In the same manner as in the first embodiment shown in FIG. 1, the sine wave amplitude $\sin \pi/W\ qR \cdot n_t$ is then multiplied with the harmonic wave amplitude coefficient $C_n$ read out from the amplitude coefficient memory device 10 to set an amplitude value $F_n$ which is converted into a musical tone signal by the musical signal generating circuit 12 thus producing a musical tone from the sound system 13**. The musical tone thus produced takes the form of an ensemble performance tone comprising a plurality of musical tones having different colors and pitches. Moreover, as the resulting musical tone varies with time, a complicated ensemble performance tone can be produced.

Although in the embodiments illustrated in FIGS. 1 and 3 the harmonic wave computation time slots were divided into 2 to 4 groups, it should be understood that the number of harmonic wave computation time slots assigned to each group and the number of groups may be of any desired magnitude. Furthermore, the musical tones synthesized in each group are not always required to have different pitches and colors. Where either the pitch or the color is made different, an ensemble performance tone can be produced.

As above described, according to this invention, since a definite number of the harmonic wave computation time slots adapted to produce respective harmonic wave components are divided into a plurality of groups for the purpose of synthesizing musical tones having different performances in respective groups, it is possible to concurrently produce a plurality of types of musical tones for one depressed key thus producing an ensemble performance tone which gives a feeling as if a plurality musical instruments are being performed concurrently. Furthermore, by varying with time the harmonic wave components which constitute grouped musical tones, the resulting musical tones are caused to vary with time thereby producing an ensemble performance like an orchestra. In addition, it is possible to set at will such ensemble performance tone by merely changing the contents of the order number memory device and the amplitude coefficient memory device with simple construction.

Although the present invention has been described in terms of presently preferred embodiments, it is contemplated that various alterations and modifications may become apparent to those skilled in the art after having read the preceding disclosure. It is therefore intended that the appended claims be interpreted as covering all such alterations and modifications as fall within the true spirit and scope of the invention.

What is claimed is:

1. An electronic musical instrument of a partials synthesis type comprising:

means for generating a frequency number signal corresponding to a tone pitch assigned to a depressed key;

a tone combination designator for producing a tone designation signal selectively designating one of a plurality of tone combinations to be produced, each said tone combination including at least two tone colors;

an order number memory device including a plurality of tone combination memory areas selectable by said tone designation signal, each said area including at least two memory sections respectively corresponding to said tone colors, each said section being adapted to store order number information corresponding to the number of orders of partials required to synthesize each of said tone colors and to output information from a memory area addressed by said tone designation signal;

an amplitude coefficient memory device adapted to store amplitude coefficients of partials corresponding to respective ones of said order numbers and to output coefficients selected by said tone designation signal;

means responsive to said frequency number signal and to said order number information for producing a plurality of tone partial waves having instantaneous wave values;

first multiplying means for multiplying said instantaneous wave values with corresponding coefficient outputs of said amplitude coefficient memory device; and means for synthesizing multiplication products produced by said first multiplying means.

2. An electronic musical instrument according to claim 1 wherein said order number memory device repeatedly produces outputs at predetermined timings and on a time division basis, and said means for producing the tone partial waves comprises:

an accumulator for accumulating said frequency number signals output by said frequency number signal generator at a repetition period determined by said predetermined timings;

second means for multiplying the outputs of said accumulator and the outputs of said order number memory device; and a wave memory device responsive to the output of said second multiplying means for sequentially reading out the outputs of the wave thereby sending out said plurality of tone partial waves on a time division basis.

3. An electronic musical instrument according to claim 1 wherein each of said memory sections comprises a plurality of memory sub-sections, and wherein said electronic musical instrument further comprises a signal generator for producing and supplying selecting signals to each one of said memory sub-sections of each one of said memory sections for selectively and sequentially reading out signals stored therein, said signal generator being triggered in response to depression of a key.

* * * * *